US005599256A

United States Patent [19]

Hughes, Jr.

[11] Patent Number: 5,599,256

[45] Date of Patent: Feb. 4, 1997

[54] HAND EXERCISER

[76] Inventor: Brickey J. Hughes, Jr., 28 E. Southhampton Ave., Hampton, Va. 23669

[21] Appl. No.: 547,400

[22] Filed: Oct. 24, 1995

[51] Int. Cl.[6] ..... A63B 23/16

[52] U.S. Cl. ..... 482/49; 482/122; 482/126

[58] Field of Search ..... 482/44, 49, 121, 482/122, 126, 129, 130

[56] References Cited

U.S. PATENT DOCUMENTS 4,268,032 5/1981 Cusi ..... 482/126

4,861,022 8/1989 Boatcallie ..... 482/126

5,441,473 8/1995 Safani et al. ..... 482/130

*Primary Examiner*—Lynne A. Reichard

*Attorney, Agent, or Firm*—Peter J. Van Bergen

[57] ABSTRACT

A hand exercise device includes a first handle pivotally connected to a second handle. A first post is mounted in fixed relation to the first handle and a second post is mounted in fixed relation to the second handle. One or more elastic bands are wrapped in tension about the first and second posts to bias the position of the first handle relative to the second handle. Movement of the first handle relative to the second handle causes further tensioning of the elastic bands.

17 Claims, 3 Drawing Sheets

HAND EXERCISER

FIELD OF THE INVENTION

The invention relates generally to exercise devices, and more particularly to a hand exercise device having variable resistance.

BACKGROUND OF THE INVENTION

Hand exercisers are well known in the art and include designs that range from the simple to the very complex. In general, hand exercisers are operated by squeezing two handles together to overcome a resistance force. The simplest design is based on two handles pivotally connected to one another via a coiled spring. A spring restraint is used to define a fixed maximum span between the handles. In the more complex designs, the spring resistance between two pivotally connected handles can be varied. Variable resistance devices are of great use to people attempting to build hand strength as in the case of hand rehabilitation and a variety of sports activities such as tennis, rock climbing, motorcycling, mountain biking, etc. Unfortunately, most of the variable resistance hand exercisers use complex spring mechanisms contained within the handles. Thus, the designs are expensive to manufacture and difficult to repair. Furthermore, both simple and complex hand exercisers generally define a fixed span between handles that greatly limit their usefulness for children or adults with small hands.

SUMMARY OF THE INVENTION

Accordingly, it is an object of the present invention to provide a hand exerciser that offers the user the ability to easily vary its resistance.

Another object of the present invention is to provide a variable resistance hand exerciser of simple design.

Still another object of the present invention is to provide a hand exerciser that is adaptable to allow a user to develop hand strength through both hand closing and hand opening motions.

Yet another object of the present invention is to provide a hand exerciser that is easily adjusted to fit a variety of hand sizes.

Other objects and advantages of the present invention will become more obvious hereinafter in the specification and drawings.

In accordance with the present invention, a hand exercise device includes a first handle and a second handle pivotally connected to the first handle at a pivot point. A first post is mounted in fixed relation to the first handle. A second post is mounted in fixed relation to the second handle. At least one elastic band is wrapped in tension about the first and second posts for biasing the position of the first handle relative to the second handle. Movement of the first handle relative to the second handle about the pivot point causes further tensioning of the one (or more) elastic band(s). Positioning of the posts determines whether the device is to be operated to develop hand closing or hand opening strength. Means can be provided to adjust the maximum span between the handles so that the device is useful with a variety of hand sizes.

DETAILED DESCRIPTION OF THE INVENTION

Figure 1:
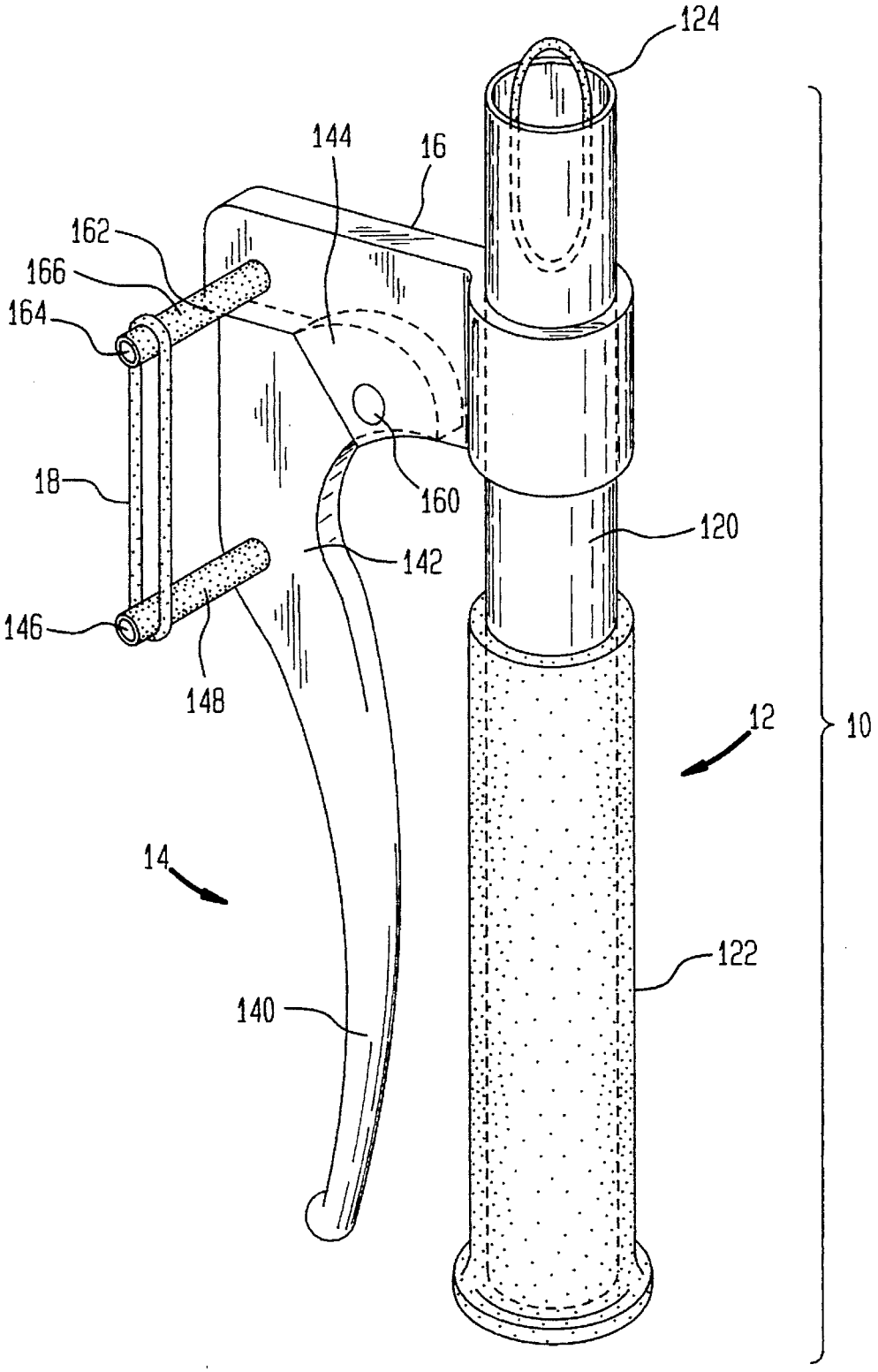
FIG. 1 is a perspective view of the hand exercise device according to one embodiment of the present invention configured to improve hand strength through a hand closing motion.

Referring now to the drawings, and more particularly to FIG. 1, the hand exercise device according to one embodiment of the present invention is shown and referenced generally by numeral 10. While a relatively specific construction of device 10 will be detailed herein for purpose of illustration, it will be apparent to one of ordinary skill in the art that other constructions could be used without departing from the scope of the present invention.

Device 10 includes handle 12 and handle 14. Handle 12 has rigid rod or pipe 120 extending the length of handle 12 with hand grip 122 surrounding a portion of pipe 120. For reasons that will be detailed further below, one end 124 of pipe 120 can be open as shown to reveal a hollow portion of pipe 120. Handle 14 is also rigid and, by way of example only, can be shaped similar to a motorcycle clutch or bicycle hand brake as shown.

Handle 14 includes finger grip area 140, head portion 142 and pivot area 144 maintained within or adjacent extension 16 depending from pipe 120. Extension 16 extends away from handle 12 to essentially form an extension thereof to provide for the pivotal connection of handle 14 to handle 12. Accordingly, extension 16 is rigidly attached to pipe 120 by any conventional means, e.g., clamped, welded, etc., or can be made integral with pipe 120. Handles 12 and 14 are pivotally connected to one another at pivot point 160. Typically, a screw bolt or rivet passes through extension 16 and pivot area 144 at pivot point 160 so that handles 12 and 14 can move towards and away from each other about pivot point 160. Bearings (not shown) can be provided at pivot point 160 to improve the pivoting action.

It is to be understood that the use of extension 16 and shape of handle 14 are only important to promote an overall appearance of device 10 that resembles a motorcycle clutch or bicycle hand brake. Thus, as will be apparent to one of ordinary skill in the art, extension 16 could be eliminated and handle 14 could be pivotally connected to handle 12 in accordance with the construction of many conventional hand exercise devices.

The maximum span between hand grip 122 and finger grip area 140 is set by the cooperation between head portion 142 and outboard end 162 of extension 16. Specifically, head portion 142 and outboard end 162 abut one another to prevent further movement of handle 14 away from handle 12.

In terms of operating device 10 to improve one's hand closing or squeezing strength, post 164 is mounted on extension 16 and post 146 is mounted an handle 14. Post 164 is generally mounted near outboard end 162 and post 146 is generally mounted on head portion 142. While the exact locations of posts 164 and 146 are not critical, it is important that post 164 is fixed relative to handle 12 and post 146 is fixed relative to handle 14. Furthermore, it is important that the locations of the pivot point between handles 12 and 14 (e.g., pivot point 160 in the illustrated embodiment), post 164 and post 146 form the apices of a triangle. Wrapped about posts 164 and 146 are one or more elastic bands. For clarity of illustration, only one elastic band 18 is shown. Elastic band 18 is sized so that it is under enough tension to remain in place when placed around posts 164 and 146. Elastic band 18 thus biases handle 14 away from handle 12 as shown until such time that handles 12 and 14 are squeezed together.

When handles 12 and 14 are squeezed together in the direction indicated by arrow 100, handles 12 and 14 pivot about pivot point 160. Since posts 164 and 146 are fixed relative to handles 12 and 14, respectively, posts 164 and 146 move away from each other during such squeezing action. The movement of posts 164 and 146 causes elastic band 18 to stretch. Accordingly, it is the resistance of elastic band 18 that must be overcome in order to squeeze handles 12 and 14 together. To prevent elastic band 18 from slipping on posts 164 and 146, each of the posts presents a non-slip surface to elastic band 18. For example, rubber sleeves 166 and 148 can be placed about posts 164 and 146, respectively.

Resistance of device 10 is controlled simply by changing the number of elastic bands 18 used and/or the elasticity of the bands. The bands could be indexed or coded based on difficulty. Any elastic bands not currently being used can be stored in open end 124 of pipe 120. Thus, the present invention is well-suited to a regimented hand strength or rehabilitation program in which the user increases resistance of device 10 in accordance with a specified plan of band usage.

Figure 2:
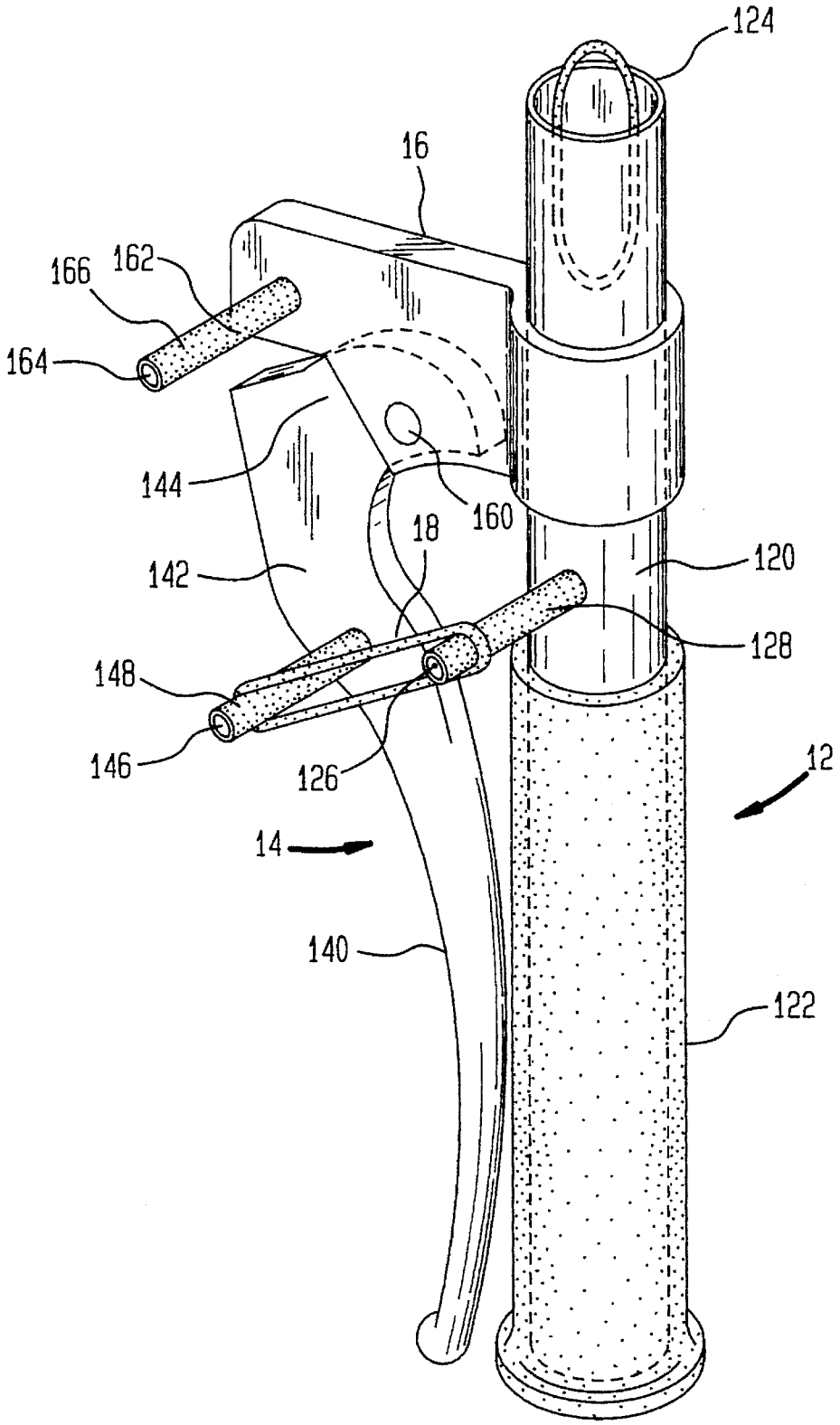
FIG. 2 is a perspective view of the hand exercise device configured to allow the user to improve hand strength through either a hand closing or a hand opening motion.

The present invention can easily be adapted so that it can be used to improve either hand closing and hand opening strength. This is accomplished by the embodiment shown in FIG. 2 where like reference numerals are used for those elements common with the elements in FIG. 1. In FIG. 2, a third post 126 is rigidly mounted to pipe 120. Post 126 can similarly have rubber sleeve 128 placed thereabout. The exact location of post 126 on pipe 120 is not critical. However, once again, it is important that the relative locations of pivot point 160, post 146 and post 124 form the apices of a triangle. When elastic band 18 is placed or wrapped about posts 146 and 126, handles 12 and 14 are biased towards one another. Configured in this fashion, device 10 can be used to improve hand opening strength as the user pushes against handle 14 with the backs of his or her fingers while performing the hand opening motion. Once again, the resistance to be overcome is provided by elastic band 18 (or multiples of elastic band 18).

Figure 3:
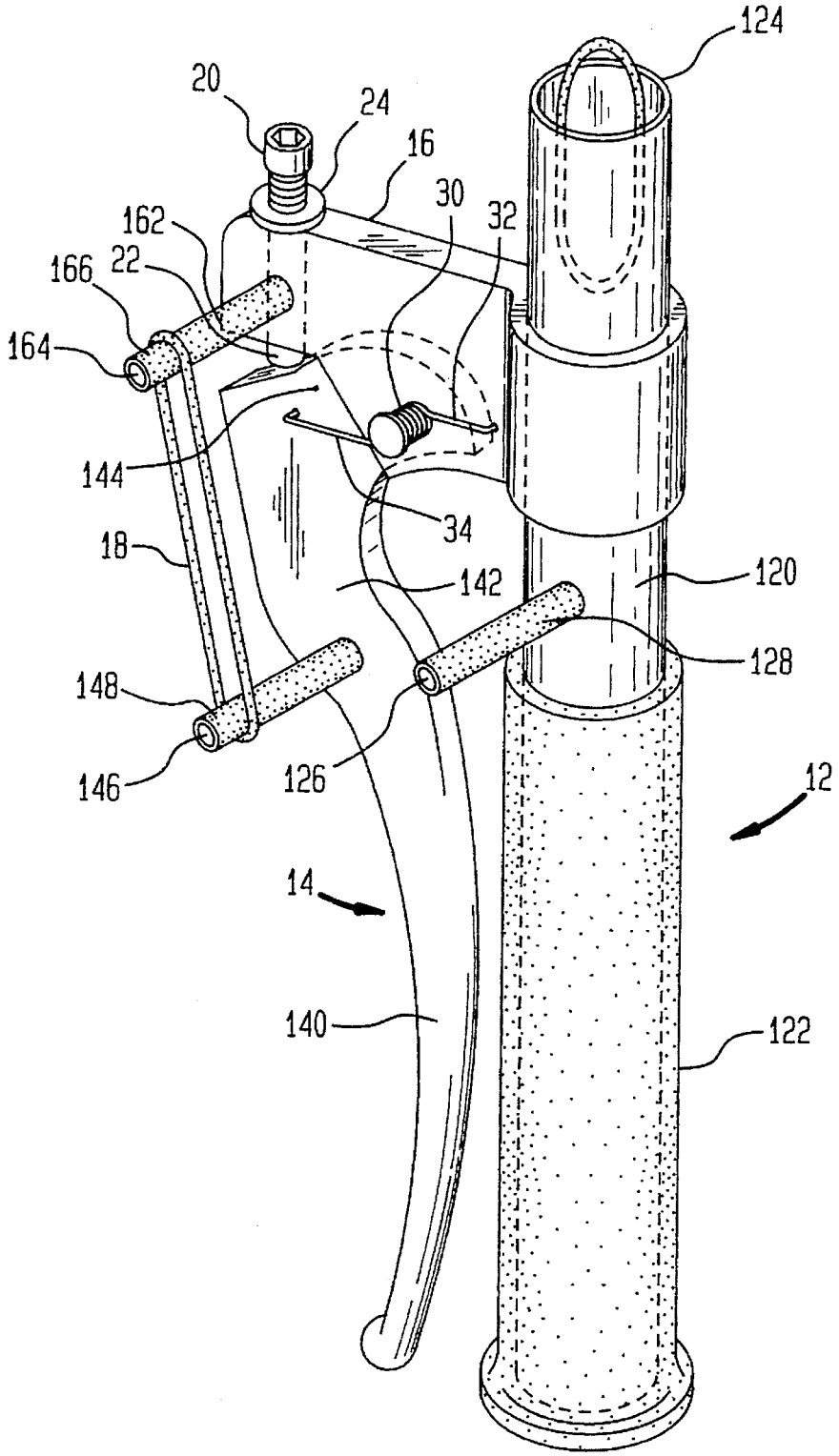
FIG. 3 is a perspective view of an alternative embodiment of the present invention that allows the span between handles to be adjusted.

The present invention can be further adapted so that the maximum opening span between handles 12 and 14 can be adjusted based on the size of the user's hand. This is accomplished by the embodiment in FIG. 3 where like reference numerals will once again be used for those elements common with the previous figures. The central portion of post 164 has been omitted for clarity of illustration. In FIG. 3, screw post 20 cooperates with outboard end 162 of extension 16 to extend therethrough. Once end 22 of screw post 20 extends beyond outboard end 162, end 22 abuts head portion 142 to reduce the "at rest" maximum span between handles 12 and 14. To lock screw post 20 in position, lock nut 24 can be provided about screw post 20. Once the position of screw post 20 is selected, lock nut 24 can be tightened against outboard end 162.

The present invention could also include a weak coil spring 30 incorporated at pivot point 160. Coil spring 30 has arms 32 and 34 that are fixed relative to handles 12 and 14, respectively. Coil spring 30 thus cooperates with handles 12 and 14 to provide a minimal resistance for biasing the handles, for example, apart from one another. This will prevent handles 12 and 14 from unwanted movement when changing elastic band configurations.

The advantages of the present invention are numerous. The resistance of the hand exercise device is easily adjusted by merely adding, removing or changing elastic bands. The simplicity of the device will be cost effective to manufacture and require minimal or no maintenance. The device can be used to improve both hand closing and hand opening strength. The span adjustment feature of the present invention allows the device to be used by people of all ages and sizes. Thus, the present invention will be of use in a variety of both hand strength and rehabilitation programs.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A hand exercise device, comprising:

a first handle;

a second handle pivotally connected to said first handle at a pivot point;

a first post mounted in fixed relation to said first handle;

a second post mounted in fixed relation to said second handle;

at least one elastic band wrapped in tension about said first post and said second post for biasing the position of said first handle relative to said second handle, wherein movement of said first handle relative to said second handle about said pivot point causes further tensioning of said at least one elastic band; and a spring mounted at said pivot point and cooperating with said first handle and said second handle to further bias the position of said first handle relative to said second handle.

2. A hand exercise device as in claim 1 wherein said first handle includes a hollow portion thereof exposed at an open end of said first handle.

3. A hand exercise device as in claim 1 wherein said first post and said second post are positioned so that said at least one elastic band biases said second handle apart from said first handle.

4. A hand exercise device as in claim 1 wherein said first post and said second post are positioned so that said at least one elastic band biases said second handle towards said first handle.

5. A hand exercise device as in claim 1 further comprising means for restricting said movement of said first handle relative to said second handle to define a maximum span between said first handle and said second handle.

6. A hand exercise device as in claim 5 further comprising means cooperating with said means for restricting and said second handle for adjusting the size of said maximum span.

7. A hand exercise device as in claim 1 wherein each of said first post and said second post present a non-slip surface about which said at least one elastic band is wrapped.

8. A hand exercise device, comprising:

a first handle;

a second handle pivotally connected to said first handle at a pivot point;

a first post mounted in fixed relation to said first handle;

a second post mounted on said second handle, wherein locations of said pivot point, said first post and said second post define a triangle;

at least one elastic band wrapped in tension about said first post and said second post for biasing the position of said first handle relative to said second handle, wherein movement of said first handle relative to said second handle about said pivot point causes further tensioning of said at least one elastic band; and a spring mounted at said pivot point and cooperating with said first handle and said second handle to further bias the position of said first handle relative to said second handle.

9. A hand exercise device as in claim 8 wherein said first handle includes a hollow portion thereof exposed at an open end of said first handle.

10. A hand exercise device as in claim 8 further comprising means for restricting said movement of said first handle relative to said second handle to define a maximum span between said first handle and said second handle.

11. A hand exercise device as in claim 10 further comprising means cooperating with said means for restricting and said second handle for adjusting the size of said maximum span.

12. A hand exercise device as in claim 8 wherein each of said first post and said second post present a non-slip surface about which said at least one elastic band is wrapped.

13. A hand exercise device, comprising:

a first handle having a longitudinal axis;

an extension depending from said first handle, said extension being angularly disposed relative to said longitudinal axis;

a second handle pivotally connected to said extension at a pivot point, wherein said extension restricts said movement of said first handle relative to said second handle to define a maximum span between said first handle and said second handle;

a first post mounted on said extension;

a second post mounted on said second handle, wherein locations of said pivot point, said first post and said second post define a triangle; and at least one elastic band wrapped in tension about said first post and said second post for biasing the position of said first handle relative to said second handle, wherein movement of said first handle relative to said second handle about said pivot point causes further tensioning of said at least one elastic band.

14. A hand exercise device as in claim 13 wherein said first handle includes a hollow portion thereof exposed at an open end of said first handle.

15. A hand exercise device as in claim 13 further comprising means cooperating with said extension and said second handle for adjusting the size of said maximum span.

16. A hand exercise device as in claim 13 further comprising a spring mounted at said pivot point and cooperating with said first handle and said second handle to further bias the position of said first handle relative to said second handle.

17. A hand exercise device as in claim 13 wherein each of said first post and said second post present a non-slip surface about which said at least one elastic band is wrapped.

* * * * *